US006904115B2

(12) United States Patent
Lin

(10) Patent No.: US 6,904,115 B2
(45) Date of Patent: Jun. 7, 2005

(54) CURRENT REGISTER UNIT AND CIRCUIT AND IMAGE DISPLAY DEVICE USING THE CURRENT REGISTER UNIT

(75) Inventor: Yen-Chung Lin, Taipei (TW)

(73) Assignee: Toppoly Optoelectronics Corp., Chunan (TW)

( * ) Notice: Subject to any disclaimer, the term of this patent is extended or adjusted under 35 U.S.C. 154(b) by 0 days.

(21) Appl. No.: 10/842,794

(22) Filed: May 10, 2004

(65) Prior Publication Data

US 2004/0239600 A1 Dec. 2, 2004

(30) Foreign Application Priority Data

May 9, 2003 (TW) ..... 92112645 A

(51) Int. Cl.[7] ..... G06M 3/00

(52) U.S. Cl. ..... 377/53; 377/68; 377/75; 345/92; 345/98; 345/100

(58) Field of Search ..... 377/53, 68, 75; 345/92, 98, 100

(56) References Cited

U.S. PATENT DOCUMENTS 5,859,630 A * 1/1999 Huq ..... 345/100

* cited by examiner

*Primary Examiner*—Margaret R Wambach
(74) *Attorney, Agent, or Firm*—Liu & Liu

(57) ABSTRACT

A current register unit. A first transistor of a first type, second to sixth transistors of a second type, and first and second capacitors are provided, and an image current signal is stored in the current register unit when a control signal is at a first logic level, and the image current signal is output by the current register unit when the control signal is at a second logic level. An image display device that utilizes the current register unit is also disclosed.

18 Claims, 15 Drawing Sheets

CURRENT REGISTER UNIT AND CIRCUIT AND IMAGE DISPLAY DEVICE USING THE CURRENT REGISTER UNIT

BACKGROUND OF THE INVENTION

1. Field of the Invention

The present invention relates to a register unit and more particularly to a current register unit for storing a current, and a current register circuit, and image display device using the unit.

2. Description of the Related Art

Organic light-emitting diode (hereinafter referred to as OLED) technology has emerged as a popular flat display technology because of its characteristics of lower cost, lower power consumption, self light-emission wider view angle, and faster response time. An OLED is a current-driven component, whose brightness is determined by current there through.

FIG. 1 shows a schematic structure of a conventional OLED display panel. As shown in the drawing, an OLED display panel 1 is formed by interlacing scan lines (represented as S1~Sn) and data lines (represented as D1~Dm). Each set of interlacing scan line and data line controls an OLED. For example, a set of interlacing scan lines S1 and data lines D1 control an OLED 100. The anode and cathode of the OLED are respectively connected with data lines (D1~Dm) and scan lines (S1~Sn). According to scan signals on the scan lines (S1~Sn), OLEDs on the same row (i.e. on the same scan line) are all turned on or off to determine whether video signals on the data lines (D1~Dm) can be input into the corresponding OLEDs.

Additionally, FIG. 1 shows a driving circuit area of the OLED display panel 1. A scan driver circuit 12 outputs scan signals (or scan pulses) to scan lines S1, S2 to Sn in a predetermined sequence. When a scan signal exists on the scan line, OLEDs of display units 10 on the corresponding row are all turned on, and OLEDs of display units 10 on other rows are all turned off. When a scan line is selected, a data driver circuit 11 outputs the corresponding video signal (a current signal) to m display units 10 on the row corresponding to the scan line through data lines D1, D2 to Dm according to image data for display.

Because brightness of the OLED of the display unit 10 is determined by the current through the OLED, a register unit for storing input current signals is a necessary and fundamental component in the data driver circuit 11.

FIG. 2*a* shows a circuit of a conventional current register unit. It comprises transistors T1~T4 and a capacitor CS. The gate of the transistor T1 receives the scan signal SS from the scan driver of the OLED display panel, and the drain of T1 receives the current signal from a control IC. The gates of the transistors T2 and T4 receive the scan signal SS as well.

FIG. 2*b* shows a sampling mode of the conventional current register unit. When the scan signal SS is at a high voltage level, the transistors T1 and T2 are turned on, and the transistor T4 is turned off. Meanwhile, a voltage at B is raised and unstable until a current $I_1$ through the transistor T3 equals the current signal. The capacitor CS stores the stable voltage at B FIG. 2*c* shows a reproduction mode of the conventional current register unit. When the scan signal SS is at a low voltage level, the transistors T1 and T2 are turned off, and the transistor T4 is turned on. The voltage difference stored in the capacitor CS acts as a voltage across gate and source (Vgs) of the transistor T3, so that current $I_2$ is generated and flows through the transistor T3, enabling OLEDs on the display panel to emit light. Therefore, a voltage signal in the capacitor CS is critical. If the voltage in the capacitor CS is changed by any noise after the sampling mode is completed, the current register unit will reproduce a current different from the stored current signal during the reproduction mode.

When a state of a transistor is changed by the scan signal, a voltage variation at a gate of the transistor will cause a voltage signal variation at a source or a drain of the transistor under the effect of parasitic capacitance (i.e. voltage coupling effect). For example, when the transistor T2 is controlled by the scan signal SS, the voltage variation at the gate of the transistor T2 will affect the voltage at B. Therefore, the current $I_2$ flowing through the transistor T3 differs from the current signal $I_1$. This would degrade the performance of the OLED.

The conventional method increases the capacitance of the capacitor CS, such that the current register unit needs longer operating time for storing the input current signal. Therefore, the operating speed of the current register unit is limited.

SUMMARY OF THE INVENTION

In one embodiment, the present invention provides a current register unit comprising a first transistor of a first type, second to sixth transistors of a second type, and first and second capacitors. The first transistor has a gate coupled to a control signal and a first source/drain coupled to an output terminal. The second transistor has a gate coupled to the control signal and a first source/drain coupled to an image current signal. The third transistor has a gate coupled to the control signal and a first source/drain coupled to a second source/drain of the second transistor. The fourth transistor has a gate coupled to a second source/drain of the third transistor and a first source/drain coupled to a first voltage level. The fifth transistor has a gate and a first source/drain, both coupled to a second source/drain of the fourth transistor and a second source/drain coupled to a second voltage level. The sixth transistor has a gate coupled to the gate of the fifth transistor, a first source/drain coupled to a second source/drain of the first transistor, and a second source/drain coupled to the second voltage level. The first capacitor has a first terminal coupled to the first voltage level and a second terminal coupled to the gate of the fourth transistor. The second capacitor has a first terminal coupled to the gate of the fifth transistor and a second terminal coupled to the second voltage level. The current register unit thereby stores the image current signal when the control signal is at a first logic level and outputs the stored image current signal when the control signal is at a second logic level.

Accordingly, the present invention also provides an image display device comprising a plurality of display units and a data driver circuit. The display units are disposed in a matrix style, which may include OLEDs, LCDs . . . The data driver circuit comprises at least a shift register circuit and a first and a second current register circuits. The shift register circuit generates a plurality of control signals. The first current register circuit has a plurality of first current register units, each of which receives the control signal and an image current signal. The first current register unit comprises a first transistor of a first type and second to sixth transistors of a second type. The first transistor has a gate coupled to the control signal and a first source/drain coupled to an output terminal. The second transistor has a gate coupled to the control signal and a first source/drain coupled to the image current signal. The third transistor has a gate coupled to the control signal and a first source/drain coupled to a second source/drain of the second transistor. The fourth transistor has a gate coupled to a second source/drain of the third transistor and a first source/drain coupled to a first voltage level. The fifth transistor has a gate and a first source/drain both coupled to a second source/drain of the fourth transistor and a second source/drain coupled to a second voltage level. The sixth transistor has a gate coupled to the gate of the fifth transistor, a first source/drain coupled to the a source/drain of the first transistor, and a second source/drain coupled to the second voltage level. The first capacitor has a first terminal coupled to the first voltage level and a second terminal coupled to the gate of the fourth transistor. The second capacitor has a first terminal coupled to the gate of the fifth transistor and a second terminal coupled to the second voltage level. The first current register unit thereby stores the image current signal when the control signal is at a first logic level and outputs the stored image current signal when the control signal is at a second logic level.

The second current register circuit has a plurality of second current register units, each of which receives the control signal and the image current signal, wherein the image current signal is output from the corresponding first register unit. The second current register unit comprises a seventh transistor of the second type and eighth to twelfth transistors of the first type. The seventh transistor has a gate coupled to the control signal and a first source/drain coupled to the display unit. The eighth transistor has a gate coupled to the control signal and a first source/drain coupled to the output terminal. The ninth transistor has a gate coupled to the control signal and a first source/drain coupled to a second source/drain of the eighth transistor. The tenth transistor has a gate coupled to a second source/drain of the ninth transistor and a first source/drain coupled to the second voltage level. The eleventh transistor has a gate and a first source/drain both coupled to a second source/drain of the tenth transistor and a second source/drain coupled to the first voltage level. The twelfth transistor has a gate coupled to the gate of the eleventh transistor, a first source/drain coupled to a second source/drain of the seventh transistor, and a second source/drain coupled to the first voltage level. The third capacitor has a first terminal coupled to the second voltage level and a second terminal coupled to the gate of the tenth transistor. The fourth capacitor has a first terminal coupled to the gate of the eleventh transistor and a second terminal coupled to the first voltage level. The second current register unit thereby stores the image current signal output from the corresponding first current register unit when the control signal is at a second logic level and outputs the stored image current signal when the control signal is at a first logic level.

Accordingly, the present invention also provides another image display device comprising a plurality of display units and a data driver circuit. The display units are disposed in a matrix style. The data driver circuit comprises at least a shift register circuit, a first current register circuit, and a second current register circuit. The shift register circuit generates a plurality of control signals. The first current register circuit has a plurality of first current register units, each of which receives a first control signal and an image current signal. The first current register unit thereby stores the image current signal when the control signal is at a first logic level and outputs the stored image current signal to the display units when the control signal is at a second logic level. The second current register circuit has a plurality of second current register units, each of which receives a second control signal and the image current signal. The phase of the second control signal is thus opposite the phase of first control signal, wherein the second current register unit stores the image current signal when the control signal is at a second logic level and outputs the stored image current signal to the display units when the control signal is at a first logic level.

BRIEF DESCRIPTION OF THE DRAWINGS

The present invention can be more fully understood by reading the subsequent detailed description and examples with reference made to the accompanying drawings, wherein.

DETAILED DESCRIPTION OF THE INVENTION

Each of the current registers is used in a single pixel or in a data driver circuit.

Figure 3:
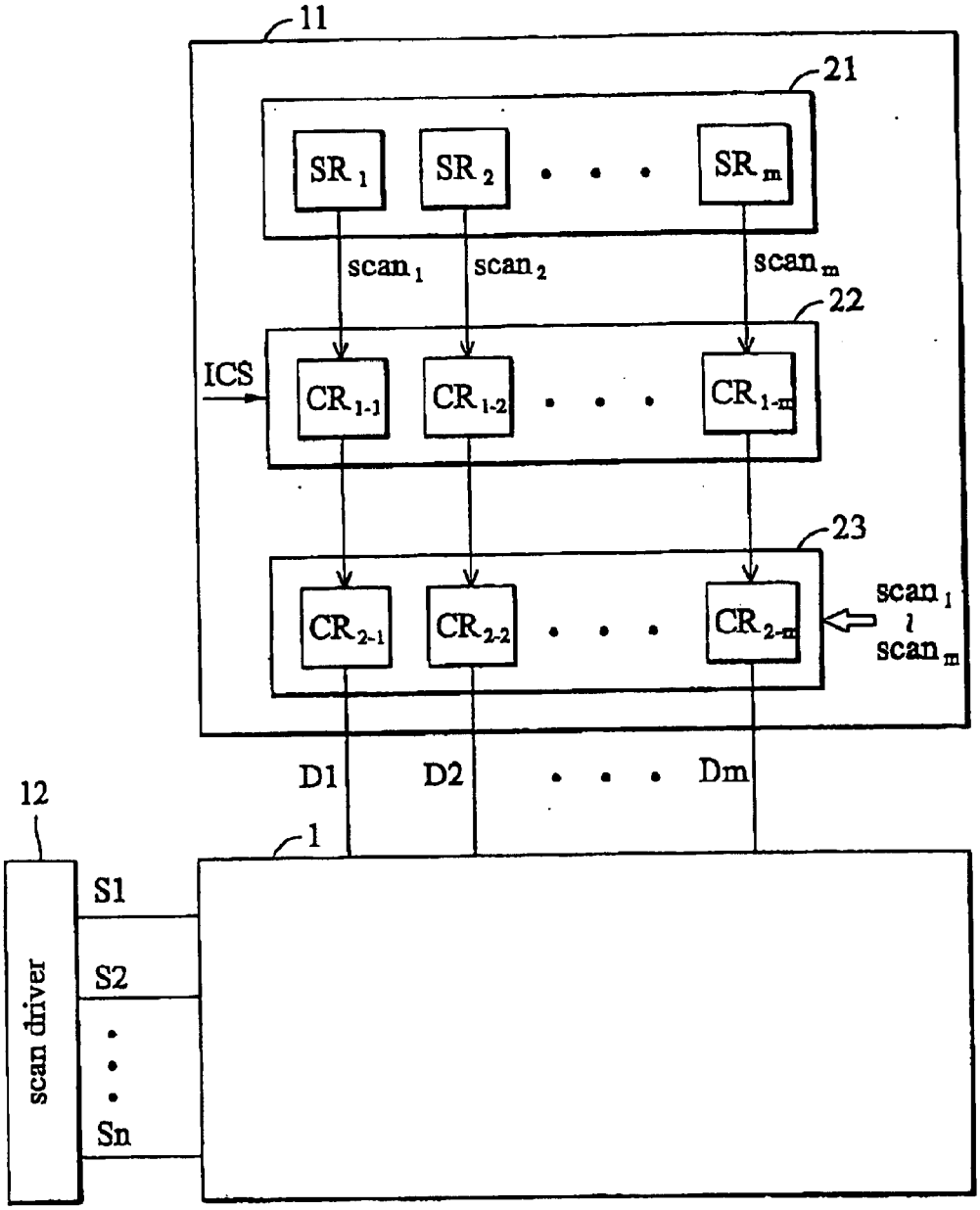
FIG. 3 is an inter-block diagram of an image display device in accordance with one embodiment of the present invention.

FIG. 3 is an inter-block diagram of an image display device of the present invention. The general operation of a display panel 1 and scan driver circuit 12 are same as conventional systems, except for the interaction with the novel data driver circuit noted herein. A data driver circuit 11 comprises a shift register circuit 21 comprises shift register units $SR_1$~$SR_m$, a first current register circuit 22, and a second current register circuit 23. The shift register units $SR_1$~$SR_m$ generates control signals $scan_1$~$scan_m$. The first current register circuit 22 comprises first current register units $CR_{1-1}$~$CR_{1-m}$, each of which receives. a first control signal $scan_1$~$scan_m$ from a corresponding shift register unit $SR_1$~$SR_m$ and an image current signal (ICS) from an outside image processor, wherein the first current register unit $CR_{1-1}$~$CR_{1-m}$ stores the ICS when the control signal $scan_1$~$scan_m$ is at a first logic level and outputs the stored ICS to the display units when the control signal $scan_1$~$scan_m$ is at a second logic level.

The second current register circuit 23 comprises second current register units $CR_{2-1}$~$CR_{2-m}$, each of which receives the control signal $scan_1$~$scan_m$ from the shift register circuit 21 and the ICS, wherein the ICS is output from the first current register circuit 22. The second current register unit $CR_{2-1}$~$CR_{2-m}$ stores the ICS when the control signal $scan_1$~$scan_m$ is at a second logic level and outputs the stored ICS to the data electrodes D1~Dm when the control signal $scan_1$~$scan_m$ is at a first logic level.

Figure 4:
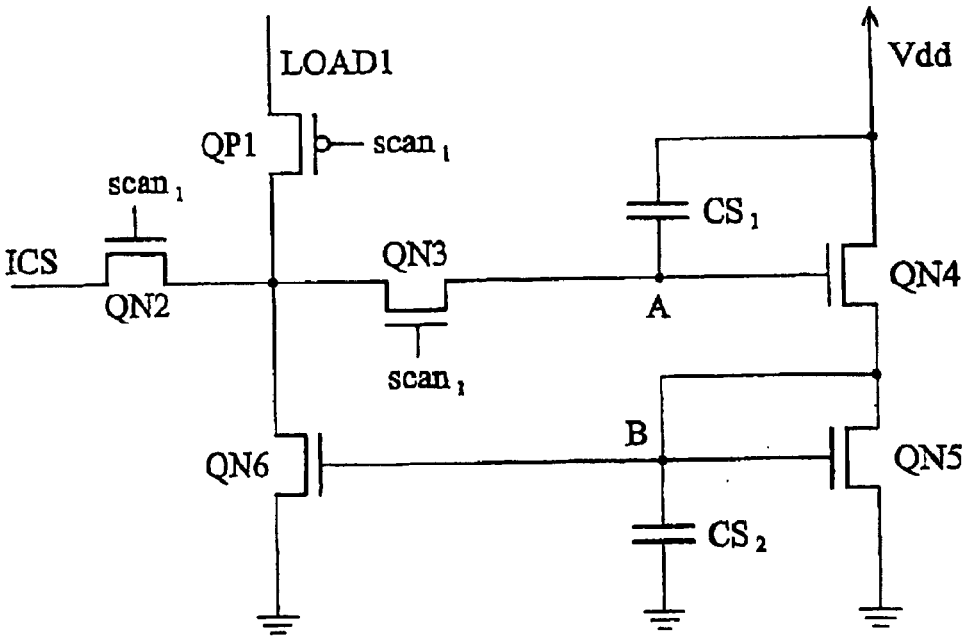
FIG. 4 shows a current register unit of the present invention.

FIG. 4 shows a current register unit ($CR_{2-1}$~$CR_{2-m}$; $CR_{2-1}$~$CR_{2-m}$) of the present invention. The current register unit comprises transistors QP1 (PMOS), QN2~QN6 (NMOS), and capacitors $CS_1$ and $CS_2$. The transistor QP1 has a gate coupled to a control signal $scan_1$ and a first source/drain coupled to an output terminal LOAD1. The transistor QN2 has a gate coupled to the control signal $scan_1$ and a first source/drain coupled to an ICS. The transistor QN3 has a gate coupled to the control signal $scan_1$ and a first source/drain coupled to a second source/drain of the transistor QN2. The transistor QN4 has a gate coupled to a second source/drain of the transistor QN3 and a first source/drain coupled to a first voltage level Vdd. The transistor QN5 has a gate and a first source/drain both coupled to a second source/drain of the transistor QN4 and a second source/drain coupled to a second voltage level. The transistor QN6 has a gate coupled to the gate of the transistor QN5, a first source/drain coupled to a source/drain of the transistor QP1, and a second source/drain coupled to the second voltage level. The capacitor $CS_1$ has a first terminal coupled to the first voltage level Vdd and a second terminal coupled to the gate of the transistor QN4. The capacitor $CS_2$ has a first terminal coupled to the gate of the transistor QN5 and a second terminal coupled to the second voltage level.

The first voltage level is a high voltage level and the second voltage level is a ground level, accordingly.

Figure 5:
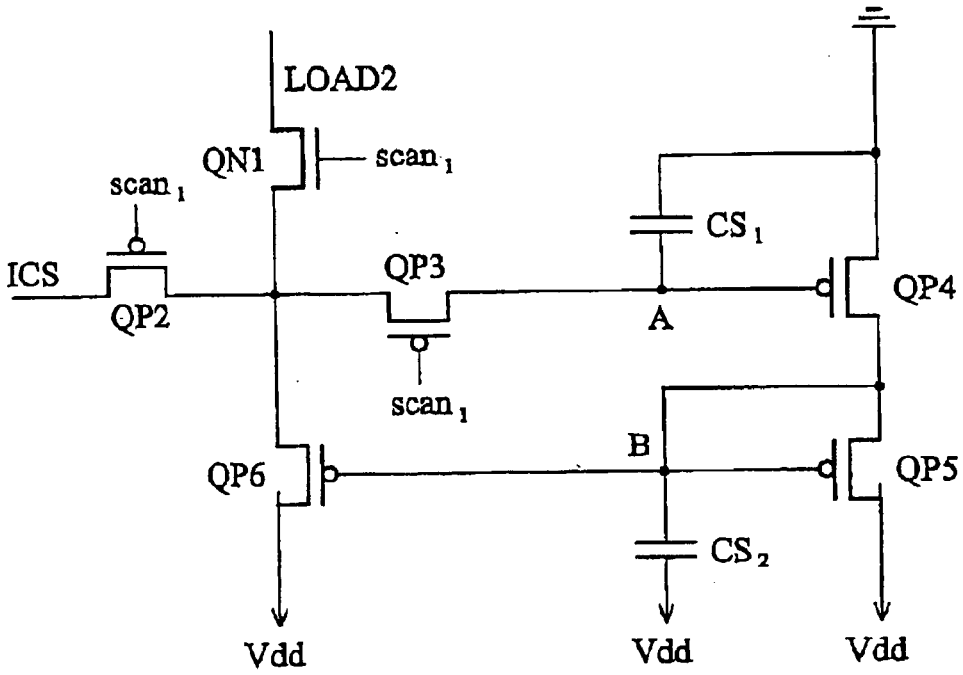
FIG. 5 is another circuit block diagram of the current register unit of the present invention.

FIG. 5 is another circuit block diagram of the current register unit of the present invention FIG. 5 shows that the type of all transistors differs from that of the first embodiment (in this embodiment, all the P-type transistors are changed to N-type transistors), as does the level of the first and second voltage levels.

Figure 6:
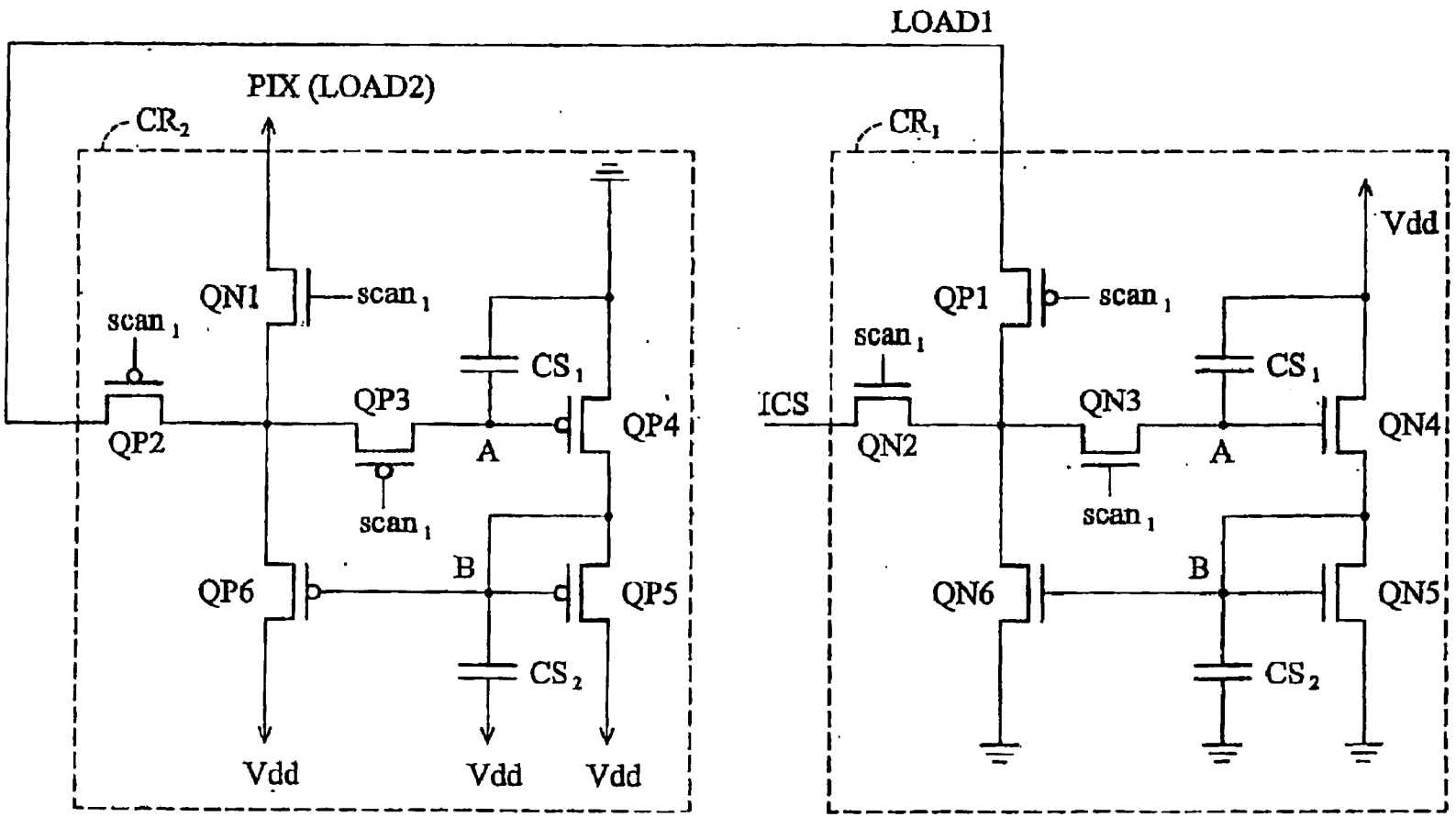
FIG. 6 shows the first current register unit connection the second current register unit in a first embodiment.

FIG. 6 shows the first current register unit connecting the second current register unit in a first embodiment. The types of the transistors of the first current register unit $CR_1$ and the second current register unit $CR_2$ are opposite Thereby, if the first current register unit $CR_1$ comprises the transistor QP1 of P-type (i.e., the configuration shown in FIG. 4), transistors QN2~QN5 of N-type and capacitors $CS_1$ and $CS_2$, the second current register unit $CR_2$ comprises transistor QN1 of N-type, transistors QP2~QP5 of P-type and capacitors $CS_1$ and $CS_2$ (i.e., the configuration shown in FIG. 5).

The first source/drain of the transistor QN2 of the first current register unit $CR_1$ is coupled to the ICS. The first source/drain of the transistor QP1 of the first current register unit $CR_1$ is coupled to the first source/drain of the transistor QP2 of the second current register unit $CR_2$. The first source/drain of the transistor QN1 of the second current register unit $CR_2$ sends the image current signal ICS to the pixel PIX (or LOAD2 as depicted in FIG. 5).

Figure 7A:
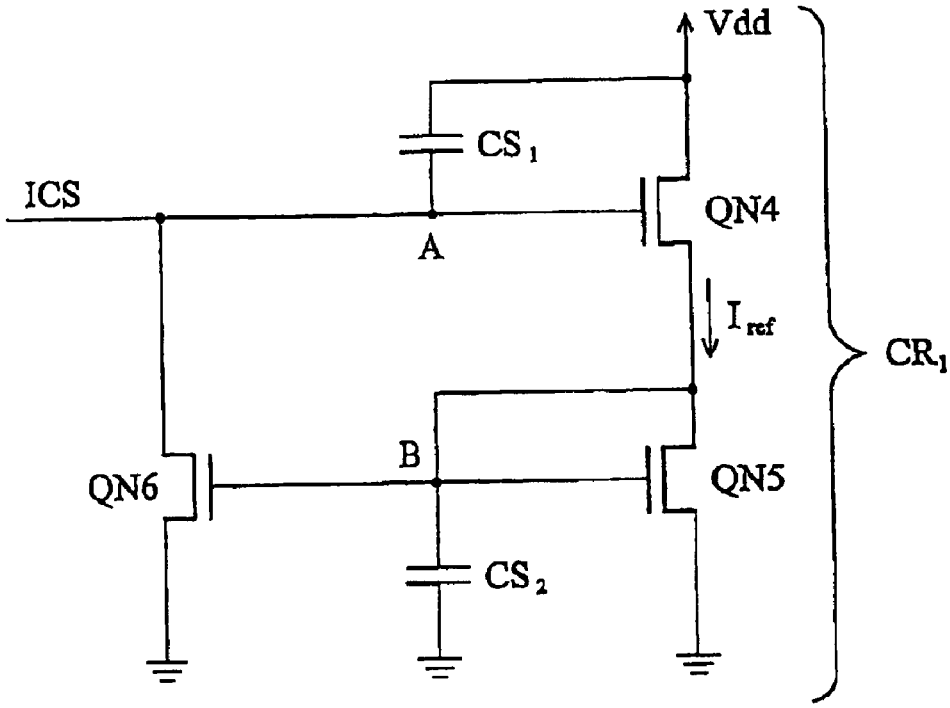
FIGS. 7*a* and 7*b* show the states of the first and second current register units when the control signal is high level.
Figure 7B:
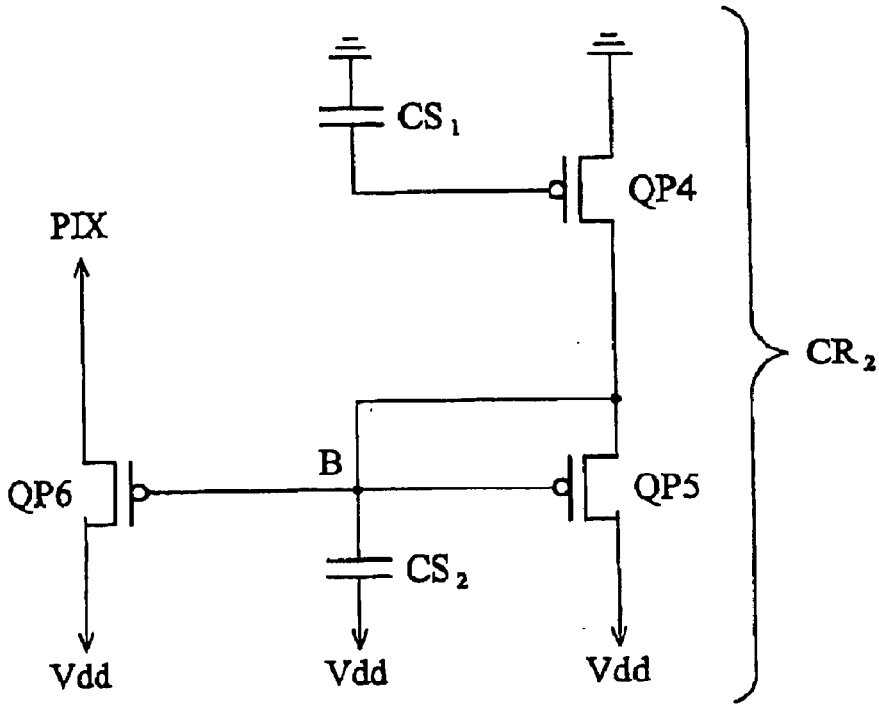

FIGS. 7*a* and 7*b* show the state of the first and second current register units when the control signal $scan_1$~$scan_m$ is at a high level. In FIG. 6, the first current register unit $CR_1$ is in sampling mode. The second current register unit $CR_2$ is in reproduction mode. The transistor QN2 is turned on and the transistor QP1 is turned off. Transistors QP2, QP3 are turned off and QN1 are turned on.

At this time, the ICS flows through the transistor QN6 of the first current register unit to the ground level. The voltage of points A and B is auto-adjusted to turn on the transistor QN6. When the current through the transistor QN6 equals the image current signal ICS, a reference current $I_{ref}$ flows through the transistor QN4 and QN5. The voltage relationship between points A and B with the image current signal is obtained as follows:

$$ICS = \frac{1}{2}\mu_n Cox\frac{W}{L}(V_{GS} - Vt)^2;$$

wherein $\mu_n$ is the mobility of an electron of the transistor, Cox is the capacitance of the area of the gate oxide unit of the transistor, W is the width of the channel of the transistor, L is the length of the channel of the transistor, Vgs is the voltage between the gate and source of the transistor, and Vt is a threshold voltage of the transistor.

The voltage of points A and B is adjusted according to the value of image current signal ICS. The voltage of point A is stored in capacitor $CS_1$. The voltage of point B is stored in capacitor $CS_2$. Therefore, current through the transistor QN6 equals the image current signal ICS.

Figure 8:
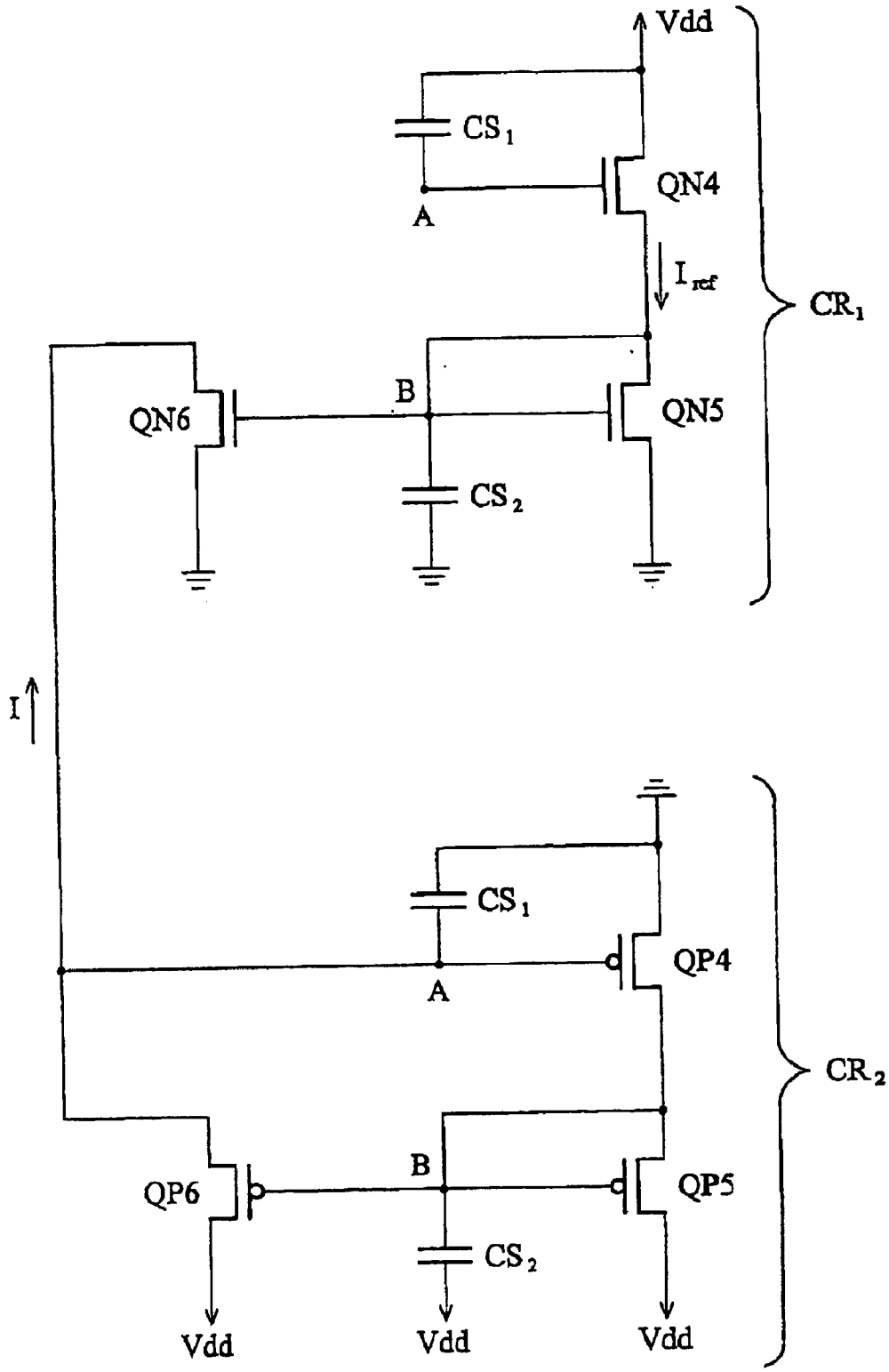
FIG. 8 shows the state of the first and second current register units when the control signal is low level.

FIG. 8 shows the state of the first and second current register units when the control signal $scan_1$~$scan_m$ is at a low level. The transistor QP1 is turned on, and transistors QN2 and QN3 are turned off. Transistors QP2 and QP3 are turned on, and transistor QN1 is turned off.

At this time, the first current register unit $CR_1$ is in reproduction mode. Because the voltage of point A is stored in capacitor $CS_1$, the reference current $I_{ref}$ is held. In any mode, the reference current $I_{ref}$ flows through the transistor QN4 and QN5 to hold the voltage of the point B. The transistor QN6 is turned on and receives a driving current equaling the image current signal ICS.

The second current register unit $CR_2$ is in sampling mode. The transistor QP6 supplies a current I to the transistor QN6. Points A and B are adjusted according to the degree of current I. The voltage of point A is stored in the capacitor $CS_1$. The voltage of point B is stored in capacitor $CS_2$. Therefore, the current I flows through the transistor QP6 and the transistor QN6.

When the control signal $scan_1$ is at high level as show in FIG. 7*b*, the transistor QP6 connects the pixel PIX and supplies the current according to the voltage stored in the capacitor $CS_2$.

Figure 1:
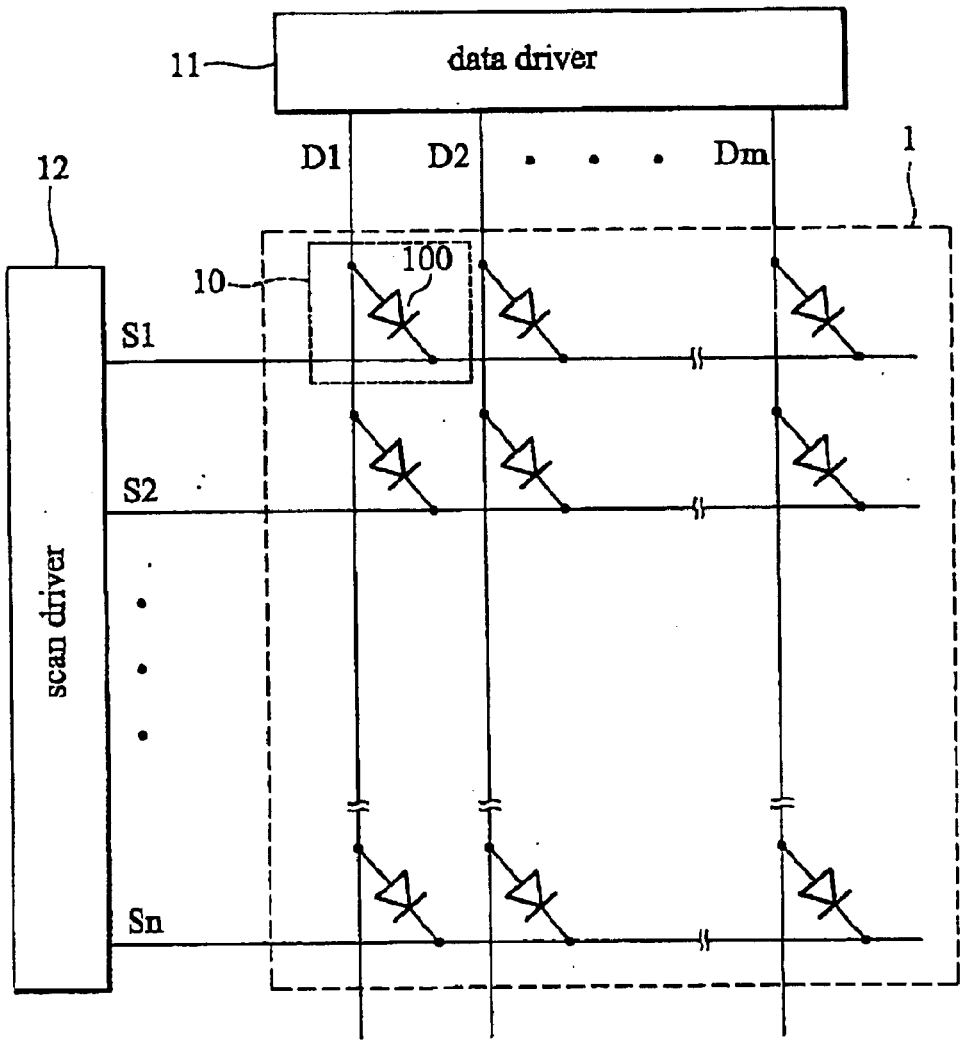
FIG. 1 shows the schematic structure of a conventional OLED display panel.
Figure 2A:
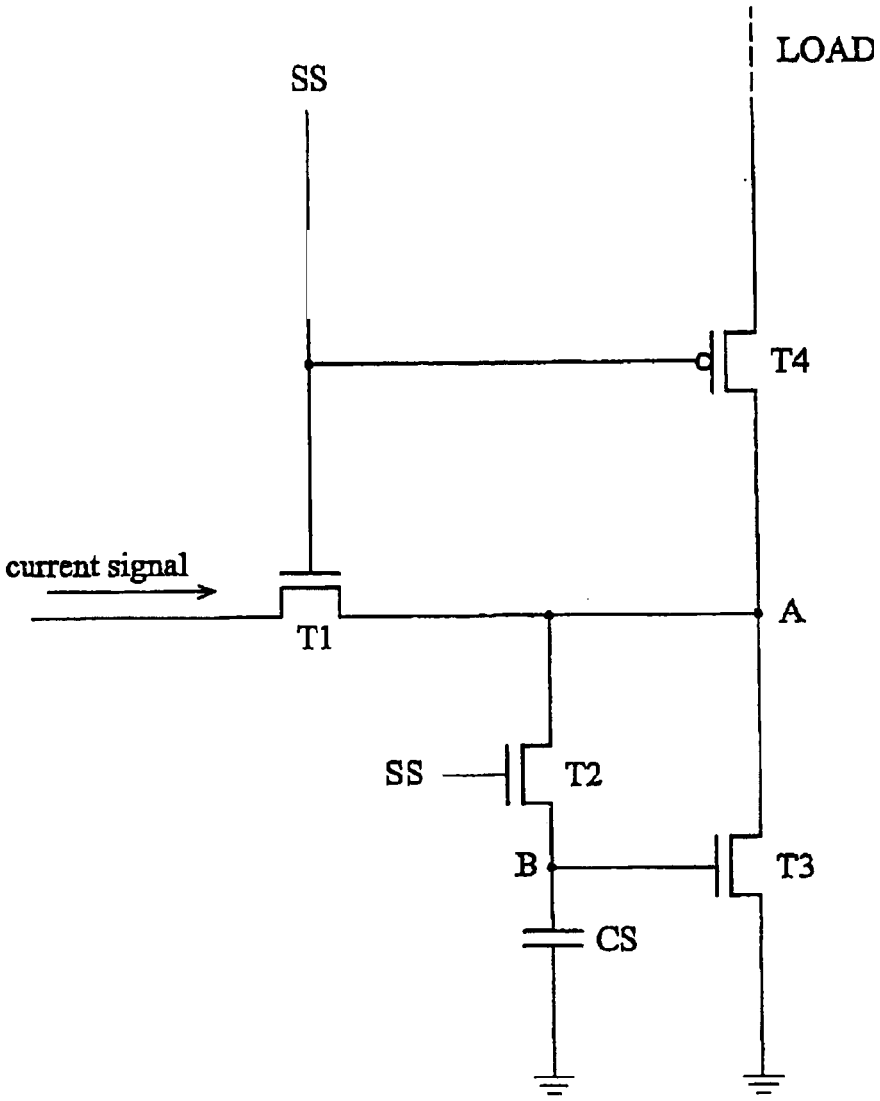
FIG. 2a ( RELATED ART )
FIG. 2*a* shows a circuit of a conventional current register unit.
Figure 2B:
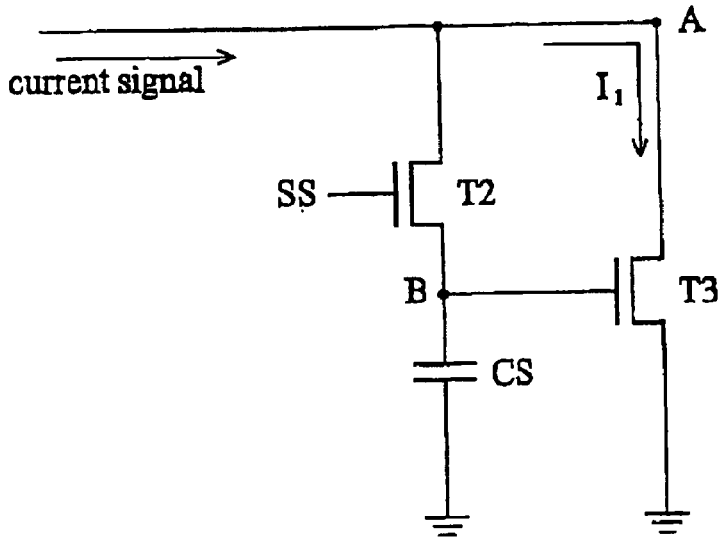
FIG. 2b ( RELATED ART )
FIG. 2*b* shows the sampling mode of the conventional current register unit.
Figure 2C:
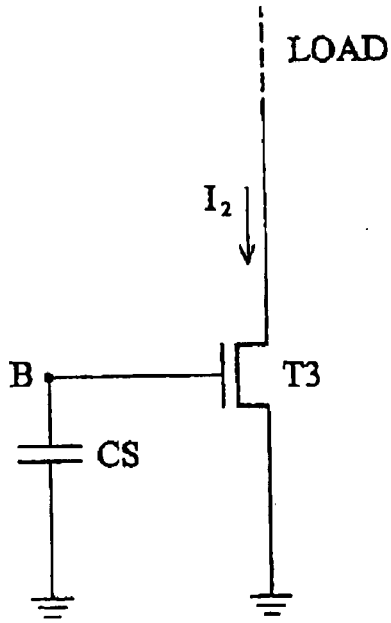
FIG. 2c ( RELATED ART )
FIG. 2*c* shows the reproducing mode of the conventional current register unit.

Therefore, the voltage at point B must be very accurate. After sampling mode, the voltage of the point B can be changed by noise, such that the output current and the stored current are different when the current register unit is in reproducing mode. In FIG. 2*a*, when the control signal SS changes the state of the transistor T2, the drain and source voltages of the transistor T2 are changed according to the parasitical capacitor of the transistor. Therefore, the voltage at B in FIG. 2 is affected. The prevent invention can alleviate this issue.

For example in first current register unit CR1 when the transistor QN3 is controlled by the control signal $scan_1$, the changed gate voltage of transistor QN3 affects the voltage of point A according to the parasitical capacitor of the transistor QN3, so the reference current $I_{ref}$ is changed. Because the gate voltage of transistor QN6 is not changed, the voltage of point B is not changed.

Figure 9:
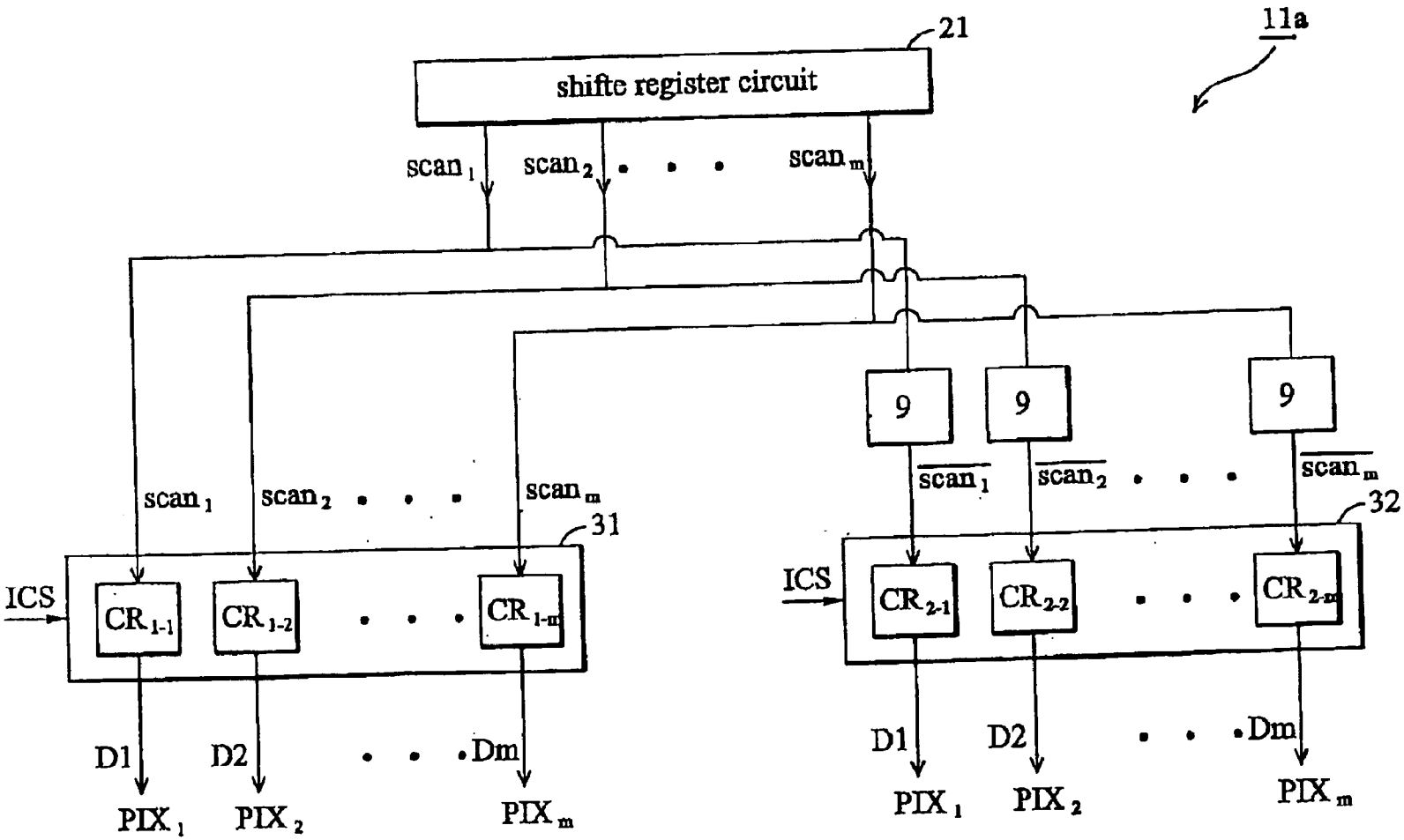
FIG. 9 shows the first current register unit connecting to the second current register unit in a second embodiment.

FIG. 9 shows a data driver circuit 11*a* in accordance with a second embodiment. The data driver circuit 11*a* comprises a shift register circuit 21, and a first current register circuit 31 and a second current register circuit 32 operatively coupled in parallel to output to the PIX. The shift register circuit 21 generates control signals $SR_1$~$SR_m$. The first current register circuit 31 comprises first current register units $CR_{1-1}$~$CR_{1-m}$, each of which receives a first control signal $scan_1$~$scan_m$ and an image current signal ICS. Each of the first current register units $CR_{1-1}$~$CR_{1-m}$ stores the image current signal ICS when the corresponding control signal $scan_1$~$scan_m$ is at a first logic level and outputs the stored image current signal ICS to the display units $PIX_1$~$PIX_m$ when the corresponding control signal $scan_1$~$scan_m$ is at a second logic level.

The second current register circuit 32 has second current register units $CR_{2-1}$~$CR_{2-m}$, each of which receives a second control signal $\overline{scan_1}$~$\overline{scan_m}$ and the image current signal ICS. The phase of the second control signal $\overline{scan_1}$~$\overline{scan_m}$ is opposite that of first control signal $scan_1$~$scan_m$. The second current register unit stores the image current signal ICS when the corresponding control signal $\overline{scan_1}$~$\overline{scan_m}$ is at a first logic level and outputs the stored image current signal ICS to the display units $PIX_1$~$PIX_m$ when the corresponding control signal $\overline{scan_1}$~$\overline{scan_m}$ is at a second logic level.

The internal circuit of the first current register circuit 31 and the internal circuit of the second current register circuit 32 have the same unit as depicted in FIGS. 4 and 5. Each of the second control signal $\overline{scan1}$~$\overline{scanm}$ is generated from the control signal $scan_1$~$scan_m$ utilizing an inverter device 9.

Figure 10A:
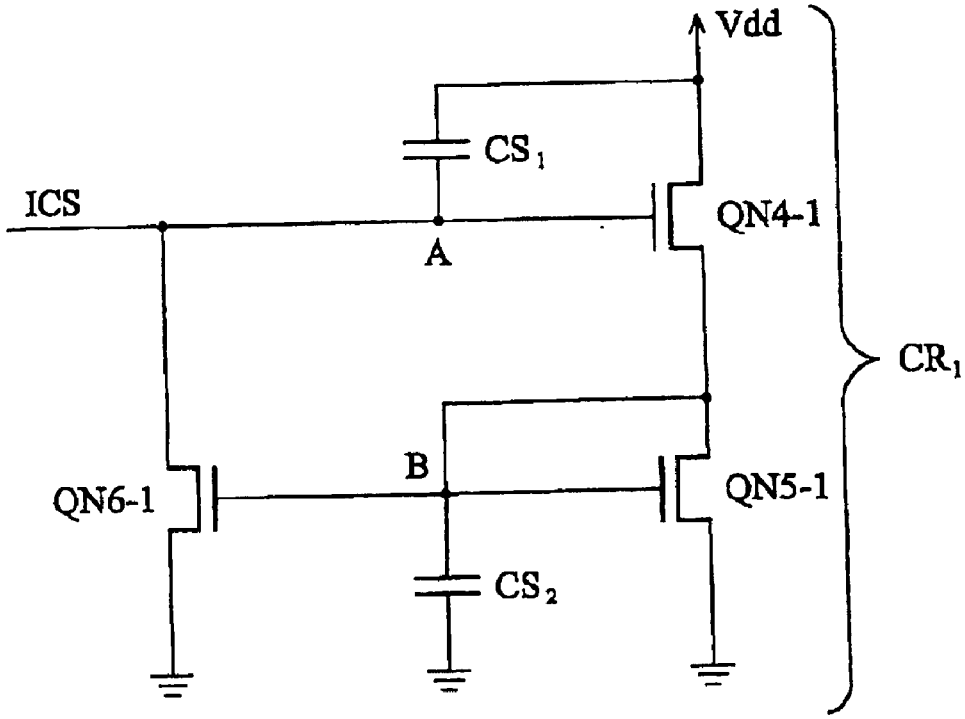
FIGS. 10*a* and 10*b* show the states of the first and second current register units when the control signal is high.
Figure 10B:
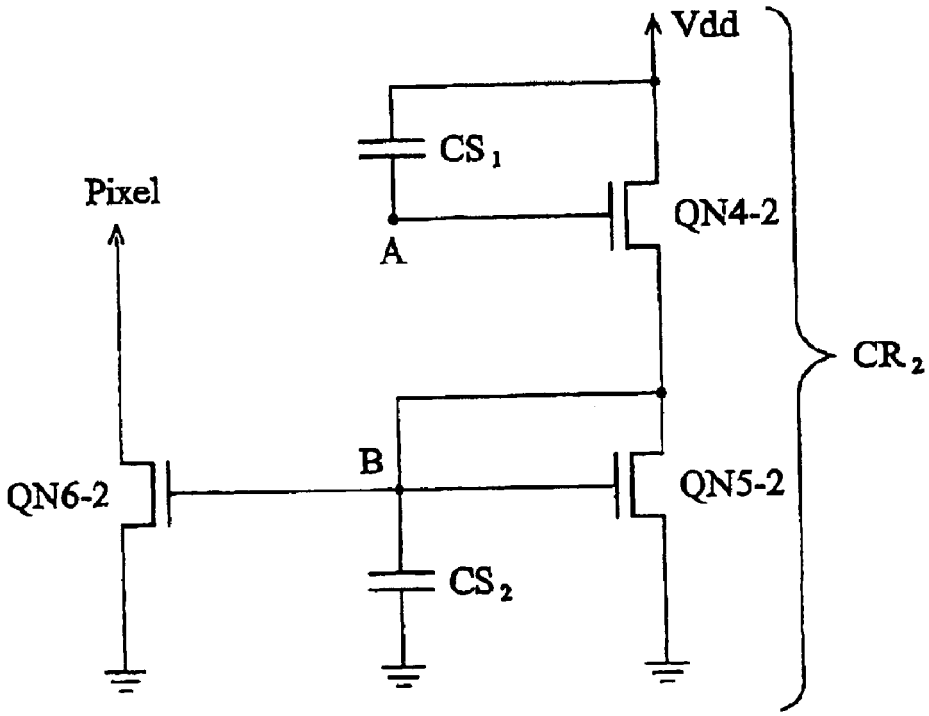

FIG. 10*a* and 10*b* show the states of the first and second current register units when the first control signal ($scan_1$~$scan_m$) is high. The first current register unit $CR_{1-1}$~$CR_{1-m}$. is in sampling mode, and the second current register unit $CR_{2-1}$~$CR_{2-m}$ is in reproducing mode. The voltage of points A and B of the first current register unit $CR_{1-1}$~$CR_{1-m}$ are adjusted according to the image current signal ICS. The voltage of point A of the first current register unit $CR_{1-1}$~$CR_{1-m}$ is stored in the corresponding capacitor $CS_1$ and the voltage of point B of the first current register unit $CR_{1-1}$~$CR_{1-m}$ in the corresponding capacitor $CS_2$. The voltage of point A of the second current register unit $CR_{2-1}$~$CR_{2-m}$ is stored in the corresponding capacitor $CS_1$ and the voltage of point B of the second current register unit $CR_{2-1}$~$CR_{2-m}$ is stored in the corresponding capacitor $CS_2$.

Figure 11A:
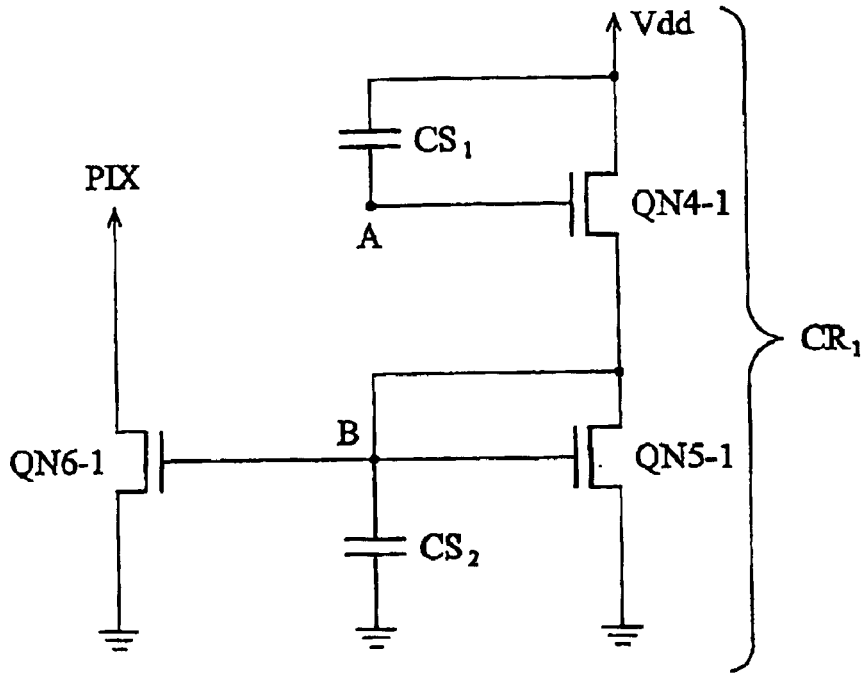
FIGS. 11*a* and 11*b* show the states of the first and second current register units when the control signal is low.
Figure 11B:
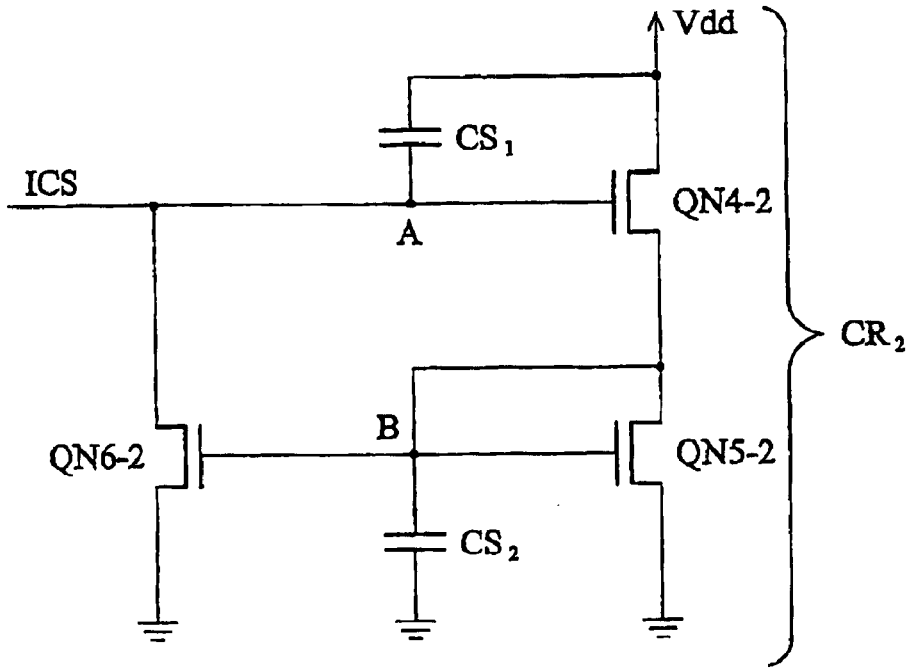

FIGS. 11*a* and 11*b* show the states of the first and second current register units when the first control signal ($scan_1$~$scan_m$) is low. The first current register unit $CR_{1-1}$~$CR_{1-m}$ is in reproducing mode, and the second current register unit $CR_{2-1}$~$CR_{2-m}$ is in sampling mode. The transistor QN6-1 of the first current register unit $CR_{1-1}$~$CR_{1-m}$ outputs current equaling the image current signal ICS. The voltage of the point A and B of the second current register unit $CR_{2-1}$~$CR_{2-m}$ are adjusted according to the image current signal ICS. The voltage of point A is stored in the capacitor $CS_1$ and the voltage of point B is stored in capacitor $CS_2$.

Figure 12:
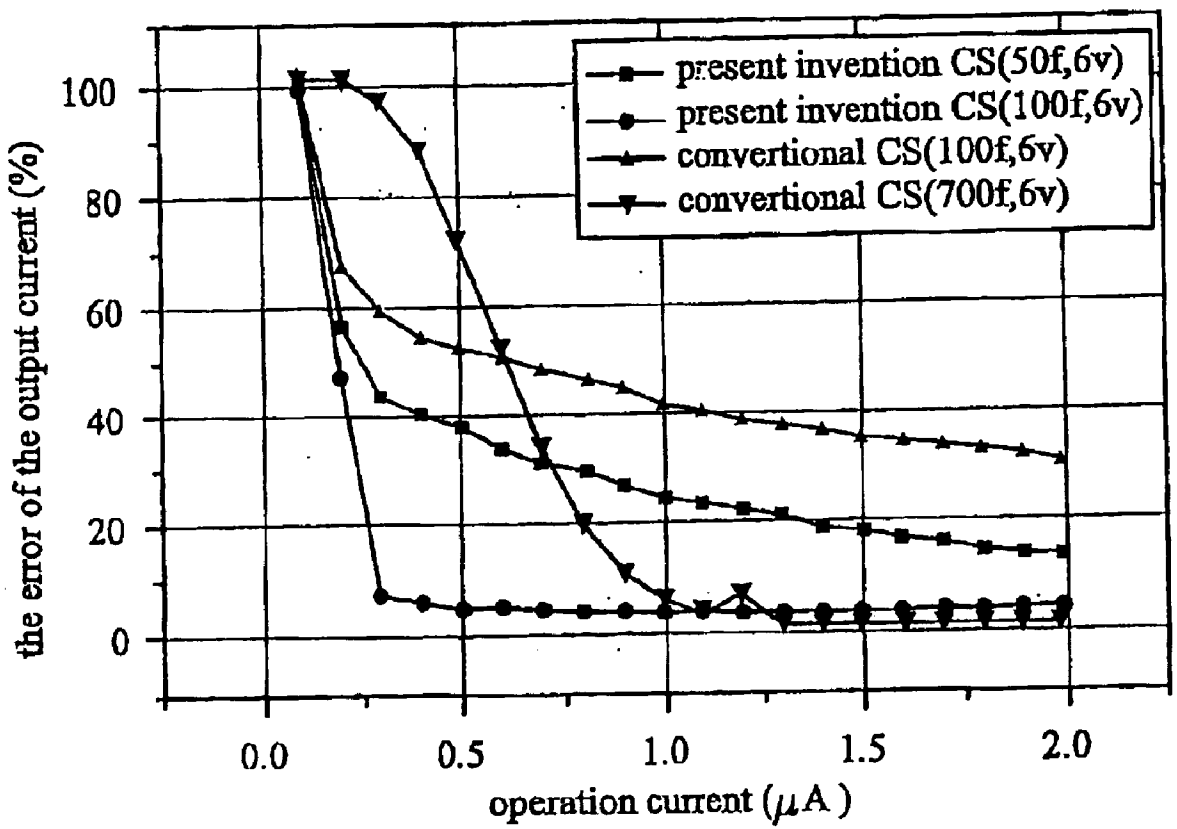
FIG. 12 shows an error in the output current graph of the conventional art and the present invention.

FIG. 12 is a graph showing the relative errors in the output current of the conventional art and the present invention. When the capacitance of capacitor CS of the conventional art is 100 F, the error of the output current exceeds 30%. The capacitance of capacitor CS of the present invention is 100 F, error in the output current is reduced to 3%.

Figure 13:
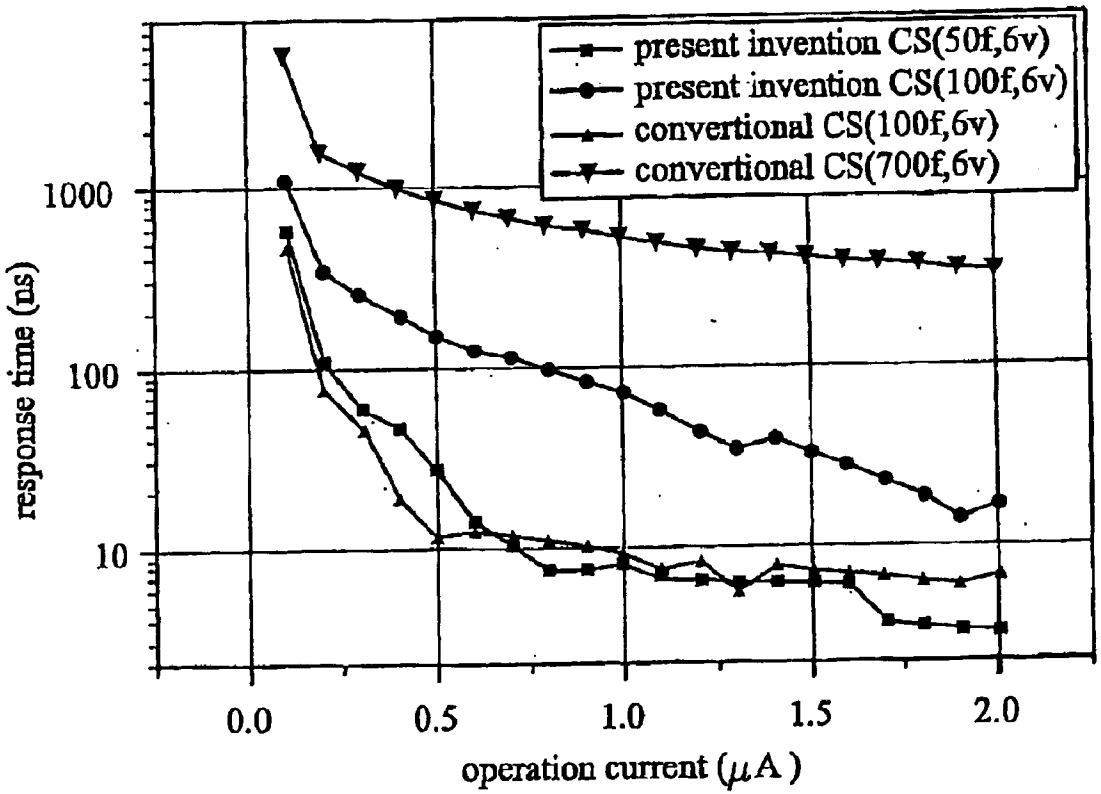
FIG. 13 shows the response time of the output current graph of the conventional art and the present invention.

FIG. 13 is a graph showing the relative response time of the output current graph of the conventional art and the present invention. When the capacitance of capacitor CS of the present invention is 100 F and the capacitance of capacitor CS of the conventional art is 700 F, the response time of the current register circuit shows clear superiority.

Figure 14:
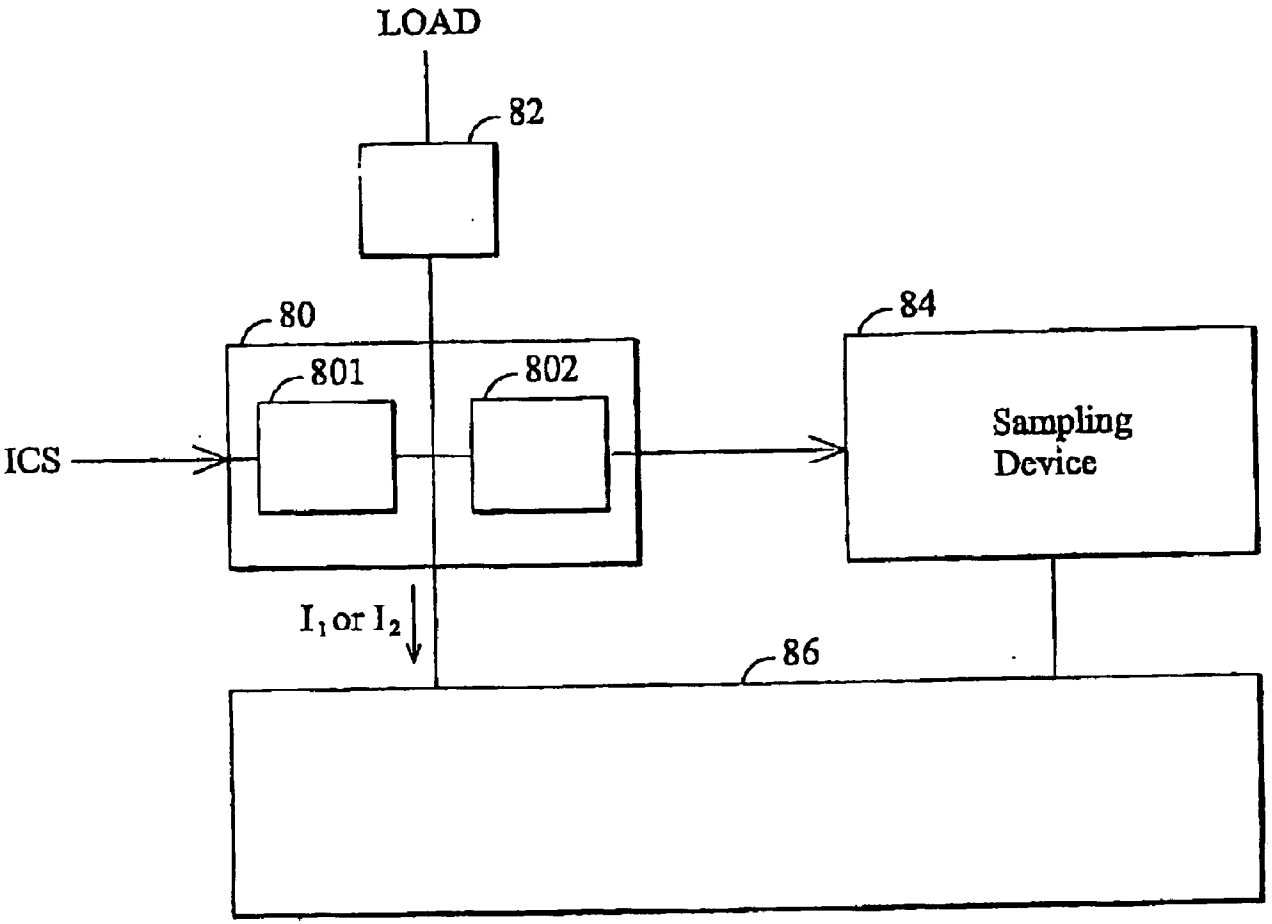
FIG. 14 is a schematic representation of an current register unit in accordance with the present invention.

FIG. 14 is a schematic representation of an current register unit in accordance with the present invention. The current register unit comprises a first switching device 80; a second switching device82; a sampling device 84; and a reproducing device 86. It is noted that the sampling device 80 stores a current signal (ICS) inputted to the first switching device 80 when the first switching device 80 turns on and when the reproducing device 86 flows a first $I_1$ current equal to the current signal ICS.

Further, the reproducing device 86 generates a second current $I_2$ according to the stored current signal when the first switching device 80 turns off and the second switching device turns on 82; and outputs the second current $I_2$ to a load through the second switching device 82. The first switching device can be made by two transistors 801 and 802 for example.

The present invention reduces error in the output current, and increases operational speed. Capacitance of the present invention is less than the conventional art thereby reducing the size of the capacitor.

Figure 15:
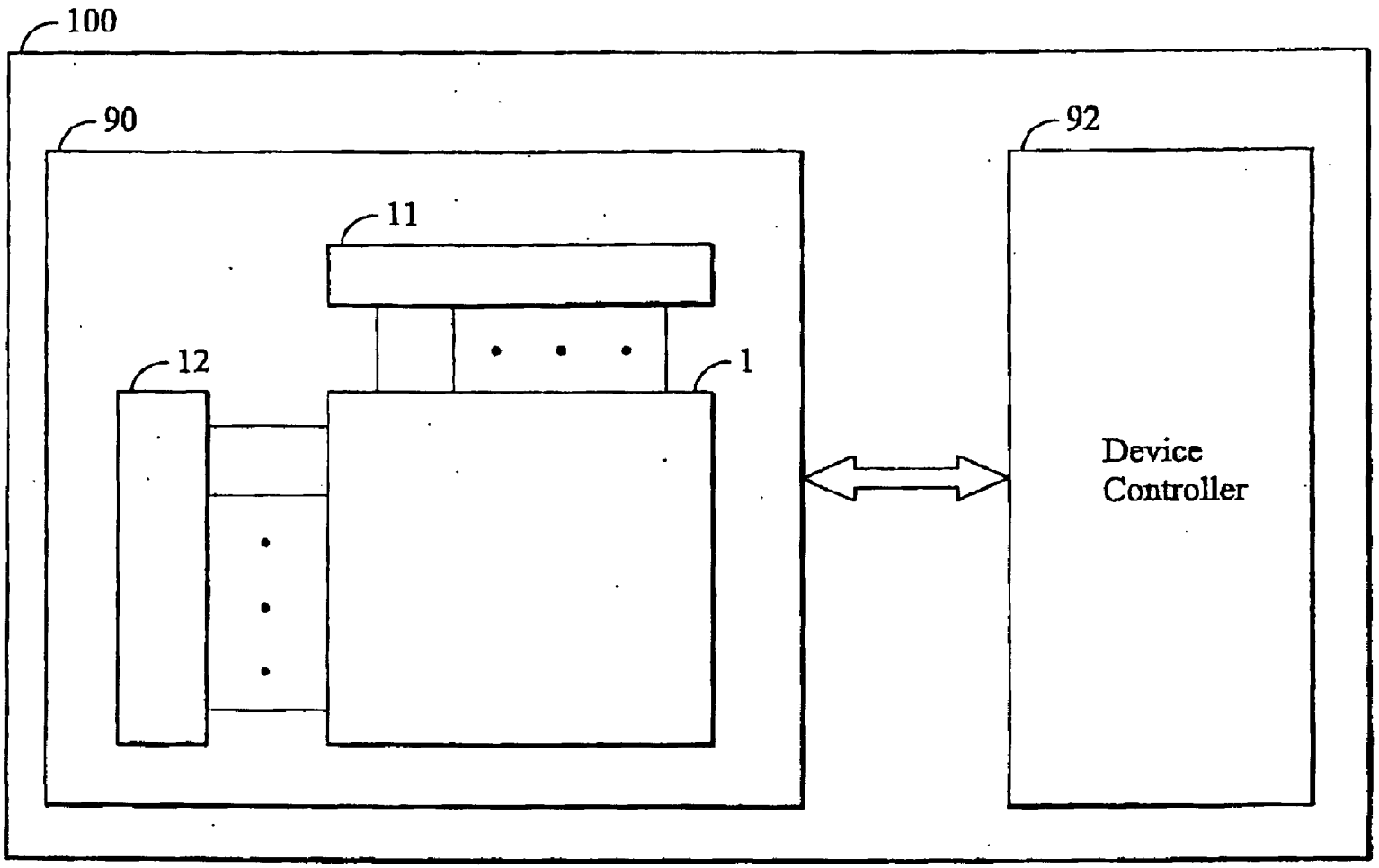
FIG. 15 is a schematic representation of an electronic device comprising an image display device in accordance with the present invention.

FIG. 15 is a schematic representation of an electronic device comprising an image display device in accordance with the present invention. The electronic device comprises an image display device 90 which is described above in conjunction with FIG. 3; and a device controller 92 coupled to the image display device 90 and configured to process data corresponding to an image to be rendered to the image display device.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art) Therefore, the scope of the appended claims should be accorded the broadest interpretation so as to encompass all such modifications and similar arrangements.

What is claimed is:

1. A current register unit comprising:

a first transistor of a first type, having a gate coupled to a control signal and a first source/drain coupled to an output terminal;

a second transistor of a second type, having a gate coupled to the control signal and a first source/drain coupled to an image current signal;

a third transistor of the second type, having a gate coupled to the control signal and a first source/drain coupled to a second source/drain of the second transistor;

a fourth transistor of the second type, having a gate coupled to a second source/drain of the third transistor and a first source/drain coupled to a first voltage level;

a fifth transistor of the second type, having a gate and a first source/drain both coupled to a second source/drain of the fourth transistor and a second source/drain coupled to a second voltage level;

a sixth transistor of the second type, having a gate coupled to the gate of the fifth transistor, a first source/drain coupled to a second source/drain of the first transistor, and a second source/drain coupled to the second voltage level;

a first capacitor, having a first terminal coupled to the first voltage level and a second terminal coupled to the gate of the fourth transistor; and a second capacitor, having a first terminal coupled to the gate of the fifth transistor and a second terminal coupled to the second voltage level;

wherein, the current register unit stores the image current signal when the control signal is at a first logic level and outputs the stored image current signal when the control signal is at a second logic.

2. The current register unit as claimed in claim 1, wherein a transistor of the first type is a P-type thin film transistor, a transistor of the second type is an N-type thin film transistor, the first voltage level is a high voltage level, and the second voltage level is a ground level.

3. The current register unit as claimed in claim 1, wherein a transistor of the first type is an N type thin film transistor, a transistor of the second type is a P type thin film transistor, the first voltage level is a ground level, and the second voltage level is a high voltage level.

4. A current register circuit having at least one current register unit, each comprising:

a first transistor of a first type, having a gate coupled to a control signal and a first source/drain coupled to an output terminal;

a second transistor of a second type, having a gate coupled to the control signal and a first source/drain coupled to an image current signal;

a third transistor of the second type, having a gate coupled to the control signal and a first source/drain coupled to a second source/drain of the second transistor;

a fourth transistor of the second type, having a gate coupled to a second source/drain of the third transistor and a first source/drain coupled to a first voltage level;

a fifth transistor of the second type, having a gate and a first source/drain both coupled to a second source/drain of the fourth transistor and a second source/drain coupled to a second voltage level;

a sixth transistor of the second type, having a gate coupled to the gate of the fifth transistor, a first source/drain coupled to a second source/drain of the first transistor, and a second source/drain coupled to the second voltage level;

a first capacitor, having a first terminal coupled to the first voltage level and a second terminal coupled to the gate of the fourth transistor; and a second capacitor, having a first terminal coupled to the gate of the fifth transistor and a second terminal coupled to the second voltage level;

wherein the current register unit stores the image current signal when the control signal is at a first logic level and outputs the stored image current signal when the control signal is at a second logic.

5. The current register circuit as claimed in claim 4, wherein a transistor of the first type is a P-type thin film transistor, a transistor of the second type is an N-type thin film transistor, the first voltage level is a high voltage level, and the second voltage level is a ground level.

6. The current register circuit as claimed in claim 4, wherein a transistor of the first type is an N-type thin film transistor, a transistor of the second type is a P-type thin film transistor, the first voltage level is a ground level, and the second voltage level is a high voltage level.

7. An image display device comprising:

a plurality of display units disposed in a matrix configuration; and a data driver circuit comprising at least:

a shift register circuit generating a plurality of control signals;

a first current register circuit, having a plurality of first current register units, each of which receives the control signal and an image current signal, wherein the first current register unit comprises:

a first transistor of a first type, having a gate coupled to the control signal and a first source/drain coupled to an output terminal;

a second transistor of a second type, having a gate coupled to the control signal and a first source/drain coupled to the image current signal;

a third transistor of the second type, having a gate coupled to the control signal and a first source/drain coupled to a second source/drain of the second transistor;

a fourth transistor of the second type, having a gate coupled to a second source/drain of the third transistor and a first source/drain coupled to a first voltage level;

a fifth transistor of the second type, having a gate and a first source/drain both coupled to a second source/drain of the fourth transistor and a second source/drain coupled to a second voltage level;

a sixth transistor of the second type, having a gate coupled to the gate of the fifth transistor, a first source/drain coupled to a second source/drain of the first transistor, and a second source/drain coupled to the second voltage level;

a first capacitor, having a first terminal coupled to the first voltage level and a second terminal coupled to the gate of the fourth transistor; and a second capacitor, having a first terminal coupled to the gate of the fifth transistor and a second terminal coupled to the second voltage level;

wherein the first current register unit stores the image current signal when the control signal is at a first logic level and outputs the stored image current signal when the control signal is at a second logic level; and a second current register circuit, having a plurality of second current register units, each of which receives the control signal and the image current signal, wherein the image current signal is output from the corresponding first register unit and wherein the second current register unit further comprises:

a seventh transistor of the second type, having a gate coupled to the control signal and a first source/drain coupled to the display unit;

an eighth transistor of the first type, having a gate coupled to the control signal and a first source/drain coupled to the output terminal;

a ninth transistor of the first type, having a gate coupled to the control signal and a first source/drain coupled to a second source/drain of the eighth transistor;

a tenth transistor of the first type, having a gate coupled to a second source/drain of the ninth transistor and a first source/drain coupled to the second voltage level;

a neleventh transistor of the first type, having a gate and a first source/drain both coupled to a second source/drain of the tenth transistor and a second source/drain coupled to the first voltage level;

a twelfth transistor of the first type, having a gate coupled to the gate of the eleventh transistor, a first source/drain coupled to a second source/drain of the seventh transistor, and a second source/drain coupled to the first voltage level;

a third capacitor, having a first terminal coupled to the second voltage level and a second terminal coupled to the gate of the tenth transistor; and a fourth capacitor, having a first terminal coupled to the gate of the eleventh transistor and a second terminal coupled to the first voltage level;

wherein the second current register unit stores the image current signal output from the corresponding first current register unit when the control signal is at a second logic level and outputs the stored image current signal when the control signal is at a first logic level.

8. The image display device as claimed in claim 7, wherein the display units comprise at least one organic light emitting diode (OLED).

9. The image display device as claimed in claim 7, wherein a transistor of the first type is a P-type thin film transistor, a transistor of the second type is an N-type thin film transistor, the first voltage level is a high voltage level, and the second voltage level is a ground level.

10. The image display device as claimed in claim 7, wherein a transistor of the first type is an N-type thin film transistor, a transistor of the second type is a P-type thin film transistor, the first voltage level is a ground level, and the second voltage level is a high voltage level.

11. An electronic device, comprising:

an image display device as in claim 7; and a device controller coupled to the image display device and configured to process data corresponding to an image to be rendered to the image display device.

12. A current register unit comprising:

a first switching device;

a second switching device;

a sampling device; and a reproducing device;

wherein the sampling device stores a current signal inputted to the first switching device when the first switching device turns on and when the reproducing device flows a first current equal to the current signal;

the reproducing device generates a second current according to the stored current signal when the first switching device turns off and the second switching device turns on; and outputs the second current to a load through the second switching device.

13. A current register as claimed in claim 12, wherein the first current and the second current flow through the same current path in the reproducing device.

14. An image display device comprising:

a plurality of display units disposed in a matrix configuration; and a data driver circuit comprising at least:

a shift register circuit generating a plurality of control signals;

a first current register circuit, having a plurality of first current register units, each of which receives a first control signal and an image current signal, wherein the first current register unit stores the image current signal when the control signal is at a first logic level and outputs the stored image current signal to the display units when the control signal is at a second logic level; and a second current register circuit, having a plurality of second current register units, each of which receives a second control signal and the image current signal, wherein the phase of the second control signal is opposite to the phase of the first control signal, wherein the second current register unit stores the image current signal when the control signal is at a second logic level and outputs the stored image current signal to the display units when the control signal is at a first logic level.

15. The image display device as claimed in claim 14, wherein the display units comprise at least one organic light emitting diode (OLED).

16. The image display device as claimed in claim 14, wherein each of the first current register units further comprises:

a first transistor of a first type, having a gate coupled to the first control signal and a first source/drain coupled to the corresponding display unit;

a second transistor of a second type, having a gate coupled to the first control signal and a first source/drain coupled to the image current signal;

a third transistor of the second type, having a gate coupled to the first control signal and a first source/drain coupled to a second source/drain of the second transistor;

a fourth transistor of the second type, having a gate coupled to a second source/drain of the third transistor and a first source/drain coupled to a first voltage level;

a fifth transistor of the second type, having a gate and a first source/drain both coupled to a second source/drain of the fourth transistor and a second source/drain coupled to a second voltage level;

a sixth transistor of the second type, having a gate coupled to the gate of the fifth transistor, a first source/drain coupled to a second source/drain of the first transistor, and a second source/drain coupled to the second voltage level;

a first capacitor, having a first terminal coupled to the first voltage level and a second terminal coupled to the gate of the fourth transistor; and a second capacitor, having a first terminal coupled to the gate of the fifth transistor and a second terminal coupled to the second voltage level; and wherein each of the second current register units comprises:

a seventh transistor of the first type, having a gate coupled to the second control signal and a first source/drain coupled to the corresponding display unit;

an eighth transistor of the second type, having a gate coupled to the second control signal and a first source/drain coupled to the image current signal;

a ninth transistor of the second type, having a gate coupled to the second control signal and a first source/drain coupled to a second source/drain of the eighth transistor;

a tenth transistor of the second type, having a gate coupled to a second source/drain of the ninth transistor and a first source/drain coupled to the first voltage level;

an eleventh transistor of the second type, having a gate and a first source/drain coupled to a second source/ drain of the tenth transistor and a second source/drain coupled to the second voltage level;

a twelfth transistor of the second type, having a gate coupled to the gate of the eleventh transistor, a first source/drain coupled to a second source/drain of the eighth transistor, and a second source/drain coupled to the second voltage level;

a third capacitor, having a first terminal coupled to the first voltage level and a second terminal coupled to the gate of the tenth transistor; and a fourth capacitor, having a first terminal coupled to the gate of the eleventh transistor and a second terminal coupled to the second voltage level.

17. The image display device as claimed in claim 16, wherein a transistor of the first type is a P-type thin film transistor, a transistor of the second type is an N-type thin film transistor, the first voltage level is a high voltage level, and the second voltage level is a ground level.

18. The image display device as claimed in claim 16, wherein a transistor of the first type is an N-type thin film transistor, a transistor of the second type is a P-type thin film transistor, the first voltage level is a ground level, and the second voltage level is a high voltage level.

* * * * *